United States Patent [19]

McGovern et al.

[11] Patent Number: 4,898,234

[45] Date of Patent: Feb. 6, 1990

[54] AIR HEAT EXCHANGER

[75] Inventors: Thomas McGovern, San Diego, Calif.; Robert B. Whitesides, Murrysville, Pa.

[73] Assignee: McDonnell Douglas Corporation, Long Beach, Calif.

[21] Appl. No.: 233,770

[22] Filed: Aug. 19, 1988

[51] Int. Cl.[4] ..... F28F 3/06; F28F 3/12

[52] U.S. Cl. ..... 165/170; 165/907; 126/445; 126/449

[58] Field of Search ..... 165/170, 907; 126/445, 126/449

[56] References Cited

U.S. PATENT DOCUMENTS

| | | | |
|---|---|---|---|
| 3,302,704 | 2/1967 | Valyi | 165/170 |
| 4,286,583 | 9/1981 | Dunn et al. | 126/445 |
| 4,387,703 | 6/1983 | Poole | 126/429 |
| 4,446,851 | 5/1984 | Grose | 126/449 |

FOREIGN PATENT DOCUMENTS

| | | | |
|---|---|---|---|
| 59-100356 | 6/1984 | Japan | 126/445 |
| 549762 | 12/1942 | United Kingdom | 165/170 |

*Primary Examiner*—Alan Cohan
*Assistant Examiner*—Allen J. Flanigan
*Attorney, Agent, or Firm*—Ben J. Yorks; George W. Finch; John P. Scholl

[57] ABSTRACT

A plurality of inlet and outlet channels for receiving and exhausting respectively the flow of a heat exchange medium directed to the inlet channels are located adjacent a plate provided with generally parallel, elongated orifices extending in the direction of and in registration with the inlet and outlet channels. A heat exchange panel is disposed adjacent the plate on the side thereof opposite that of the channels such that the medium entering the input channels travels through the orifices of the plate to the heat exchange panel and then from the panel to and through the outlet channels.

6 Claims, 2 Drawing Sheets

AIR HEAT EXCHANGER

BACKGROUND OF THE INVENTION

The present invention relates to heat exchange devices, and particularly to a heat exchange device that provides a minimum pressure differential across the device and high heat transfer rates in the device.

Because of its low heat capacity, and hence the slow rate at which air is capable of transferring heat, air has not generally been selected as a first choice for a heat exchange medium. Water, for example, and the well known hydrocarbon refrigerants are employed because of their substantial capacity to transfer heat.

What is therefore needed in the heat exchange art, and provided by the present invention, is a heat exchange structure and arrangement that will permit particularly the use of air and other gases in applications where the use of liquids might not be suitable or feasible, and where air and other gases are plentiful.

SUMMARY OF THE INVENTION

The present invention is directed to an arrangement of components that permits attainment of the above objective. The objective is obtained by allowing high rates of medium flow through the components, i.e., in excess of 1,000 scfm. More particularly, a combination of elements, including a plurality of relatively shallow, side by side inlet and outlet channels for the introduction and removal of a heat exchange medium, is provided in combination with a plate structure having a plurality of elongated orifices located in direct alignment and registration with the inlet and outlet channels. Each inlet and outlet channel has a corresponding orifice. On the side of the orifice structure opposite the channels and-in intimate contact with the orifice structure is located a heat exchange member and surface. The heat exchange member and surface is preferably a rigid panel of expanded foam material through the invention is not limited thereto.

The orifice structure and heat exchange member are located parallel to each other but in a geometric angled relationship, such as perpendicular, to the walls that form the inlet and outlet channels. In this manner, when a heat exchange medium is directed into the inlet channels, the medium flows through the elongated orifices in registration with the inlet channels and into the foam material. The orifices distribute the medium to and from the foam material and form the dominant pressure drop in the system of the components. From the foam material the medium travels immediately to the elongated orifices in registration with the outlet channels to exhaust through the outlet channels. Such an arrangement provides short, open flow paths for the medium to rapidly distribute in the heat exchange member. In this manner, a minimum pressure drop or differential develops across the arrangement, and medium contact time with the heat exchange member is short, as discussed in detail hereinafter. Further, high volume flow rates of the medium are effected so that high heat transfer rates are obtained.

To maintain a constant velocity of the medium traveling through the device, the inlet and outlet channels are non-uniform, i.e., the inlet channels narrow in the direction of medium flow so that the velocity of the medium flowing into the elongated slots remains constant. Similarly, the exhaust channels gradually increase in the direction of outlet flow so that the velocity of the flow leaving the elongated slots and traveling into the expanding outlet channels remains substantially constant.

THE DRAWING

The advantages and objectives of the invention will be best understood from consideration of the following detailed description along with the accompanying drawings wherein.

PREFERRED EMBODIMENT

Figure 1:
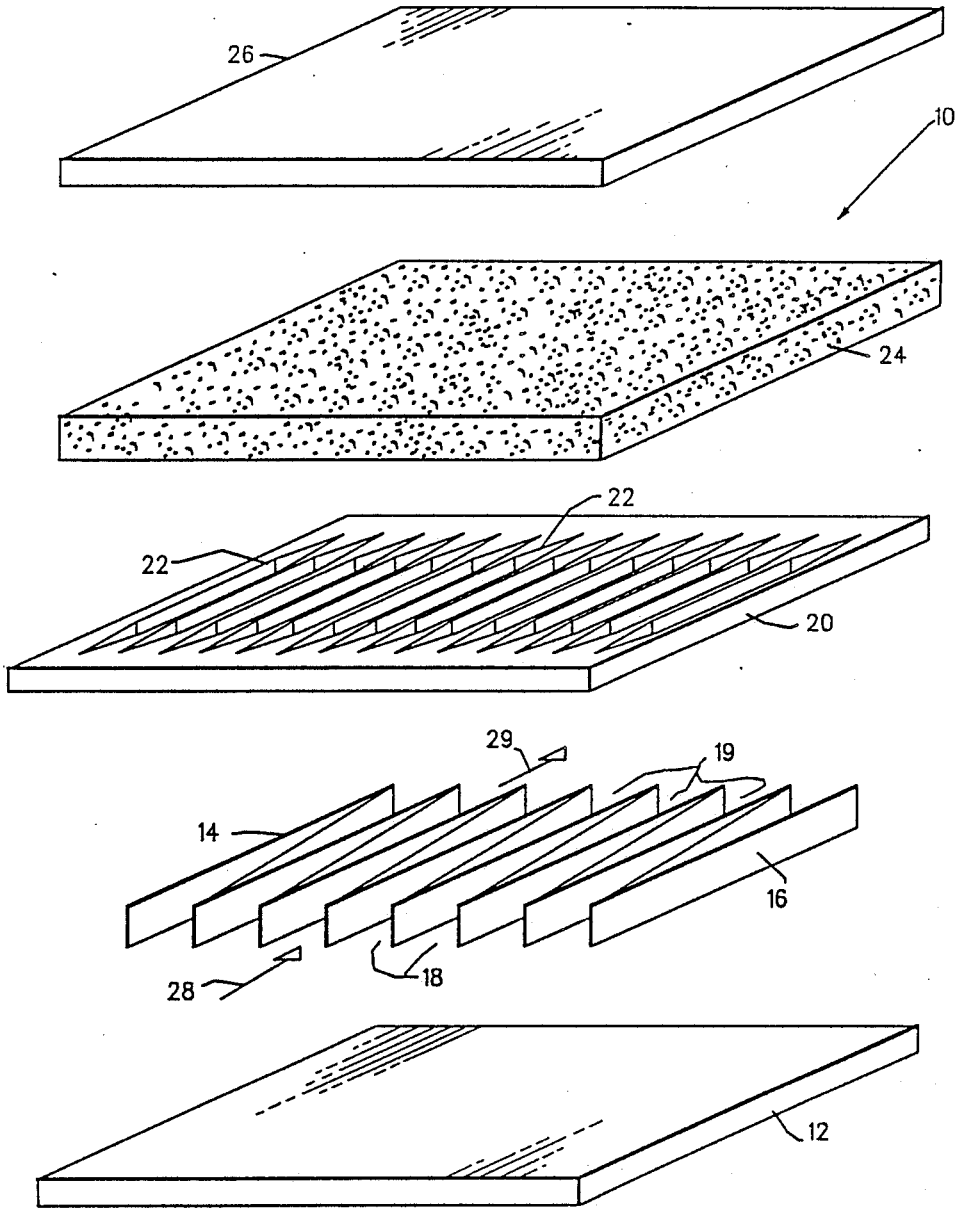
FIG. 1 is an exploded view showing the components of the heat exchanger.

Referring now to the drawings, FIG. 1, is an exploded view of the components of a heat exchange device 10. The lowermost component shown in the figure is a simple solid panel or plate 12. This plate or panel forms one outermost wall of the device. The overall structure of heat exchanger 10, however, need not be planar. It can have other configurations. The planar configuration of the drawing is chosen to simplify the explanation of the operation of the heat exchanger.

The next component is depicted as a folded wall structure 14. This structure is comprised of a plurality of shallow, side-by-side solid wall portions 16 providing a plurality of relatively shallow, side-by-side elongated ducts or channels 18 and 19. The channels have changing cross-sections in traveling to and from the apices of the folded structure. The lowermost edges of wall portions 16 are disposed against the upper surface of plate 12 when heat exchange device 10 is assembled. Structure 14 can be fabricated in any number of ways. It can, for example, be an integral folded structure, as generally depicted in the FIG. 1 or wall portions 16 can be separate members disposed together in the manner shown.

The planes of the walls 14 are shown disposed perpendicular to the plane of base plate 12, and perpendicular to the plane of an orifice plate or wall 20 located above wall structure 14 in FIG. 1. Again, however, walls 16 need not be perpendicular to the planes of the plates 12 and 20, i.e., walls 16 can occupy an angled position other than perpendicular relative to the planes of 12 and 20.

Figure 2:
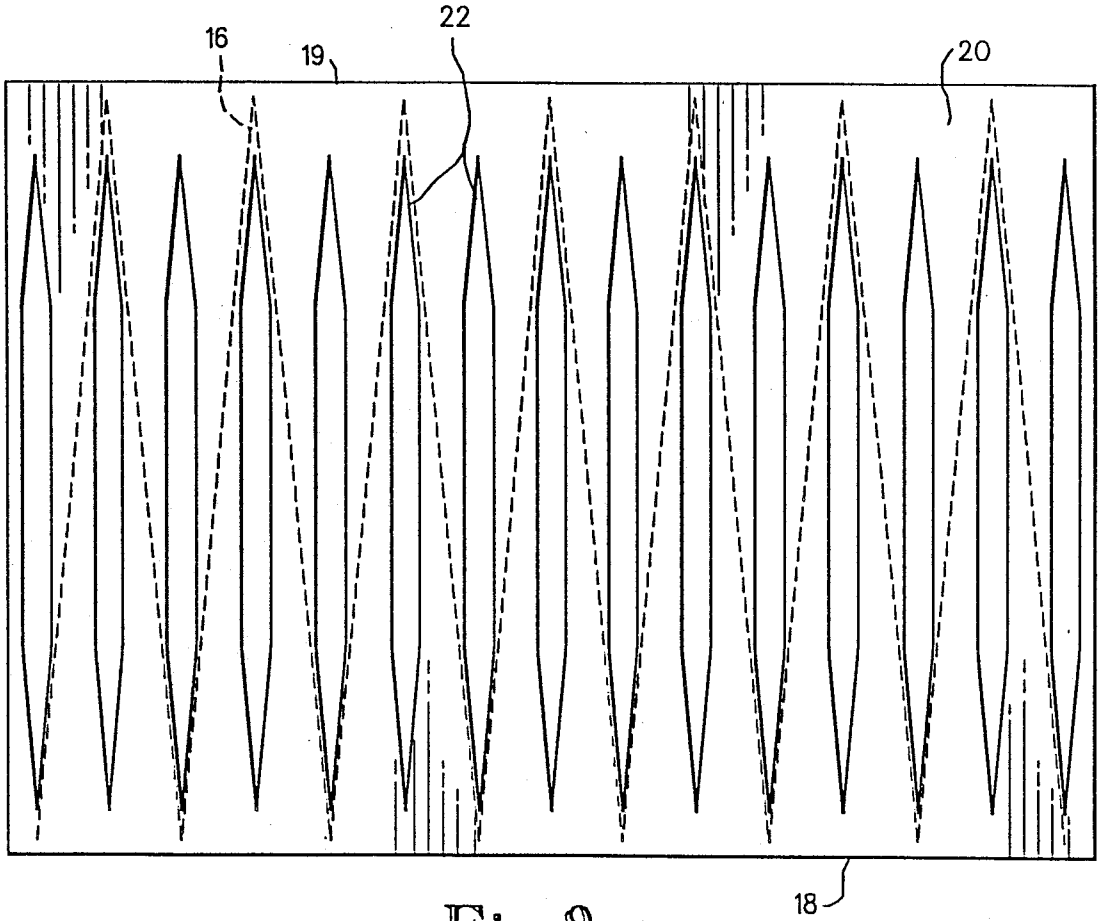
FIG. 2 is an enlarged view of the orifices registered with the inlet and outlet channels.

Orifice structure 20 is provided with a plurality of elongated orifices 22, the plate being oriented such that the orifices 22 extend in the direction of and are located in registration with channels 18 and 19 of the wall structure 14 as shown in FIG. 2 Each inlet channel 18 and each outlet channel 19 has a corresponding orifice 22. When the heat exchange device 10 is assembled, the orifice structure 20 is disposed against the edges of walls 16 opposite to the edges of the walls 16 located against base plate 12.

Immediately above orifice structure 20, as shown in figures, and disposed against and in intimate contact with the upper surface of the structure is a heat exchange panel 24. Panel 24 is preferably a rigid panel structure of expanded foam material, though the invention is not limited thereto. A foam material is preferred because of the extensive surface areas available for contact by a heat exchange medium. A variety of rigid foam materials are commercially available. Other suitable structures would include a housing containing fin means, wool types of material or tubular sections. And, as indicated earlier, panel 24 need not be planar.

If the heat exchange panel 24 is an expanded foam structure, a solid upper panel or wall 26 is disposed in intimate contact with 24. The upper wall 26 is needed to complete the enclosure of foam panel 24, as such a panel is inherently porous. Similarly the four edges or sides of the foam panel 24 are enclosed in a manner that prevents the escape of the heat exchange medium from the edges or sides.

The heat exchange function provided by device 10 works in the following manner. A heat exchange medium is directed into one of the two open edges of duct wall 14, as indicated by arrow 28 in FIG. 1. In such a case, channels 18 are the inlet ducts of the device, while channels 19 become the outlet or exhaust ducts. The medium travels down all of the channels 18 and upwardly through all of the elongated orifices 22 of structure 20 located over the channels 18. The orifices 22 direct the medium to heat exchange member 24, where the heat exchange function takes place, i.e., the outwardly (upwardly in the drawing) facing surface of 24 performs a cooling or heating function. If 24, for example, is a ceiling tile or panel in a room, it would serve to cool or heat the room. If upper wall 26 is used, panel 24 conducts its temperature condition to wall 26, the two being in intimate contact with each other.

After contacting panel 24, and traveling through the foamed structure thereof, if 24 is an expanded foam member, and after transferring its thermal condition to 24 and 26, the medium returns through all of the elongated orifices 22 located over the exhaust channels 19 of duct structure 14 to exhaust from heat exchange device 10, as indicated by arrow 29.

The travel time and distances through the foam material of 24 are short such that there is minimum pressure drop and the heat exchange rate is high. A suitable width for the entrance of ducts 18 can be two inches. With the orifices 22 of the plate 20 centered over wall 16 that separates inlet ducts 18 from outlet duct 19, lateral flow distance can be short, i.e., as one inch, for the medium entering the ducts. Under worse case conditions, in testing the system of the invention, using the above dimensions and a two-inch thick foam panel of 6% density, the pressure drop in the system was always less than one psi (For a given volume, percent density is the amount of ligament material of the foam, the remainder of the volume, i.e., the 94% is the medium). The dominant pressure drop in the system is through the elongated slots, which distribute the medium to 24 to provide a uniform flow of the medium through 24. Because the flow volume through 24 is large and rapid, the system of the invention can accommodate a heat load up to 5500 BTUs per hour per foot squared.

Because of the decreasing cross section of inlet channels 18 in moving toward the apices of the channels 18, the velocity of the medium entering the orifices 22 is maintained constant. It can be appreciated that the fluid entering channels 18 initially enters at its maximum velocity and passes through the initial portion of each orifice 22 at maximum velocity. However, as the fluid proceeds into the channels 18 and into orifices 22 it will lose velocity if the channels 18 have a constant cross-section. By appropriately decreasing the cross-sections of 18, the fluid is progressively confined such that its rate of flow does not decrease as it passes into orifices 22.

Similarly, because of the increasing cross section of outlet channels 19, the medium entering channels 19 along the extents of orifices 22 maintains a constant exhaust velocity.

The same functions can be effected by appropriately changing the widths for orifices 22.

The proximity of a plurality of inlet 18 and outlet 19 channels to elongated orifices 22 provided in a panel or plate 20 structure, and the proximity of the channels 18 and 19, to a heat exchange member, 24 serve to limit head pressure in the heat exchange device of the invention and the contact time of a fluid stream with the heat transfer member. This causes the efficiency of the arrangement to be high. As such, heat transfer rate is high so that air or other low heat capacity fluids can be used as the heat exchange medium.

While the invention has been described in terms of preferred embodiments, the claims appended hereto are intended to encompass all embodiments which fall within the spirit of the invention.

What is claimed is:

1. A heat exchange device providing a minimum pressure differential across the device and high heat transfer rates in the device, comprising:

a plurality of inlet and outlet channels for receiving and exhausting respectively the flow of a heat exchange medium directed to the inlet channels, a plate-type structure located adjacent and in general parallel relation to the channels, said plate structure having a plurality of elongated orifices extending in the direction of and in registration with the inlet and outlet channels, each inlet and outlet channel having a corresponding orifice and, a heat exchange panel disposed adjacent the orifice structure and on the side thereof opposite that of the channels such that the medium entering the input channels travels through the inlet channels and through the orifices corresponding thereto to the heat exchange panel and then from the panel through the orifices corresponding to the outlet channels and then through the outlet channels.

2. The heat exchange device of claim 1 in which the heat exchange medium is air or other gases.

3. The heat exchange device of claim 1 in which the cross sections of the inlet channels decrease in the direction of the flow of the medium in said channels, while the cross sections of the outlet channels increase in the direction of medium flow.

4. The combination of claim 1 in which the heat exchange panel is a rigid panel structure of expanded foam material.

5. A heat exchange device providing a minimum pressure differential across the device and high heat transfer rates in the device, comprising:

a plurality of wall structures providing a plurality of side-by-side inlet and outlet channels for receiving and exhausting respectively the flow of a heat exchange medium directed to the inlet channels, a plate structure located adjacent the wall structures, said plate structure having a plurality of elongated orifices extending in the direction of and in registration with the inlet and outlet channels, each inlet and outlet channel having a corresponding orifice, and a heat exchange panel disposed adjacent the orifice structure and on the side thereof opposite that of the channels such that the medium entering the input channels travels through the inlet channels and through the orifices of the structure corresponding thereto to the heat exchange panel and then from the panel through the orifices corresponding to the outlet channels and then through the outlet channels.

6. A heat exchange device providing a minimum pressure differential across the device and high heat transfer rates in the device, comprising:

a plurality of wall structures providing a plurality of side-by-side inlet and outlet channels for receiving and exhausting respectively the flow of a heat exchange medium directed to the inlet channels, the cross sections of the inlet channels decreasing in the direction of the flow of the medium in said channels, while the cross sections of the outlet channels increase in the direction of medium flow a plate located adjacent and in perpendicular relation to the wall structures, said plate having a plurality of elongated orifices extending in the direction of and in registration with the inlet and outlet channels, each inlet and outlet channel having a corresponding orifice and a rigid, expanded foam, heat exchange panel disposed adjacent the orifice plate and on the side of the plate opposite that of the wall structures and in substantial parallel relation to the plate, such that the medium entering the wall structures travels through the inlet channels and through the orifices of the plate corresponding thereto to the heat orifices corresponding the outlet channels and then through the outlet channels.

* * * * *